United States Patent [19]

Suzuki et al.

[11] Patent Number: 4,969,012

[45] Date of Patent: Nov. 6, 1990

[54] IMAGE RECORDING APPARATUS WITH AN INTERMEDIATE PHOTOSENSITIVE MEMBER

[75] Inventors: Makoto Suzuki, Nagoya; Mitsuo Yamane, Yokkaishi; Hitoshi Nakai; Takeshi Miyabayashi, both of Nagoya, all of Japan

[73] Assignee: Brother Kogyo Kabushiki Kaisha, Aichi, Japan

[21] Appl. No.: 204,197

[22] Filed: Jun. 8, 1988

[30] Foreign Application Priority Data

| | | | |
|---|---|---|---|
| Jun. 9, 1987 | [JP] | Japan | 62-143480 |
| Jun. 9, 1987 | [JP] | Japan | 62-143482 |
| Jun. 9, 1987 | [JP] | Japan | 62-143483 |
| Jun. 9, 1987 | [JP] | Japan | 62-143485 |
| Jun. 9, 1987 | [JP] | Japan | 62-143479 |

[51] Int. Cl.[5] ..... G03G 5/00; G03G 15/01

[52] U.S. Cl. ..... 355/212; 355/326; 355/327

[58] Field of Search ..... 355/242, 212, 256, 315, 355/326, 327, 27, 32, 202

[56] References Cited

U.S. PATENT DOCUMENTS

| | | | |
|---|---|---|---|
| 3,627,410 | 2/1968 | Jugle | 355/326 |
| 3,972,608 | 8/1976 | Moriyama et al. | 355/212 X |
| 4,173,407 | 11/1979 | Kuehnle . | |
| 4,324,484 | 4/1982 | Johnson | 355/202 X |
| 4,647,182 | 3/1987 | Pierce | 355/326 |
| 4,663,257 | 5/1987 | Murasawa et al. | 355/256 X |
| 4,772,922 | 9/1988 | Kawahara et al. | 355/212 X |
| 4,849,785 | 7/1989 | Tanabe | 355/326 X |

FOREIGN PATENT DOCUMENTS

| | | | |
|---|---|---|---|
| 61-77866 | 4/1986 | Japan . | |
| 1278325 | 6/1972 | United Kingdom . | |
| 2204705 | 11/1988 | United Kingdom | 355/326 |

OTHER PUBLICATIONS

J. A. C. Yule, "Color Reproduction in the Graphic Arts", *Neblette's Handbook of Photography and Reprography*, pp. 466–476, 1977.

*Primary Examiner*—A. T. Grimley
*Assistant Examiner*—William J. Royer
*Attorney, Agent, or Firm*—Oliff & Berridge

[57] ABSTRACT

An image recording apparatus has a photochromic photosensitive member with a light transmittance that is variable dependent on the light applied to it from an original that has been illuminated by a first light source. A second light source, which emits a light that the photochromic photosensitive member is insensitive to, is then used to form an electrostatic latent image on an uniformly charged photosensitive sheet with the photosensitive sheet being carried on the surface of a transfer drum past one or more developing devices in order to make the electrostatic latent image on the photosensitive sheet a visible image. A mask member film may alternatively be used between an exposure light source and the photosensitive sheet.

6 Claims, 7 Drawing Sheets

IMAGE RECORDING APPARATUS WITH AN INTERMEDIATE PHOTOSENSITIVE MEMBER

BACKGROUND OF THE INVENTION

The present invention relates to an image recording apparatus for recording an image on a photosensitive sheet.

One known image recording apparatus for recording an image on a photosensitive sheet is disclosed in Japanese Laid-Open Patent Publication No. 61-77866, for example. In this conventional image recording apparatus, the photosensitive sheet is exposed to light which has been reflected from an original to be imaged or copied.

Exposure of the photosensitive sheet to such light bearing image information requires a large amount of light energy to be applied to the photosensitive sheet. Therefore, a large-size light source is necessary for applying light to the original, and so is a large-size power supply to energize the light source. For recording or copying color images, it is necessary to employ a special photosensitive sheet which has been processed for dye sensitization as by being coated with sensitized dyes so as to be sensitive to lights in different colors such as red, green, and blue.

The photosensitive sheet disclosed in Japanese Laid-Open Patent Publication No. 61-77866 is shown in FIG. 9 of the accompanying drawings. The photosensitive sheet, designated by the reference numeral 230, comprises a support 220 of paper or film, an aluminum layer 210 deposited on the support 220 by vacuum evaporation, and a photoconductive layer 200 of $TiO_2$. Since the photosensitive sheet 230 is substantially impermeable to light, it is not suitable for use on an overhead projector. To prepare a sheet for use on an overhead projector, it is necessary to transfer the toner image on the photosensitive sheet 230 onto another transparent film.

There is known an image recording apparatus or copying apparatus including an exposure device employing an intermediate film for forming an intermediate image thereon. Conventional exposure devices of this type have an expensive unit for forming an intermediate image on an intermediate film, and require various highly costly articles to be consumed. To eliminate these drawbacks, there have been devised wire-dot-matrix exposure devices.

To one conventional wire-dot-matrix exposure device, the image of an original is illuminated by an original exposure lamp and focused through a three-color separation filter onto a CCD (charge-coupled device) by a focusing lens. The intensity of light falling on the CCD is converted to an electric signal thereby which is then amplified by an amplifier. The amplified signal is applied to a driver (not shown) which issues a control signal to control a wire-dot-matrix printer head to form a color-separated image on a sheet of plain paper unreeled from a sheet roll with a monochromatic ink ribbon. Therefore, a photosensitive sheet is exposed to light through the paper sheet, serving as an intermediate sheet, and the image thus formed on the photosensitive sheet is developed into a visible image by set-type image developing devices through a known process disclosed in Japanese Laid-Open Patent Publication No. 61-77866. Then, the photosensitive sheet is passed between a pair of image fixing rollers to reproduce a colored image on the photosensitive sheet.

Since inexpensive plain paper may be used as the intermediate sheet, the cost of the exposure device is low.

However, the aforesaid wire-dot-matrix exposure device has proven unsatisfactory in that it is time-consuming to form an intermediate image on the intermediate sheet. Moreover, inasmuch as it is necessary to form three successive intermediate images of different colors on respective three intermediate sheets, these successive intermediate sheets have to be brought into exact registry with each other in order to reproduce a clear colored image.

Generally known color image recording or copying apparatus can be categorized into silver-salt photographic copying apparatus, thermal-transfer copying apparatus, and electrophotographic copying apparatus. The silver-salt color photographic copying system is advantageous in that produced images are of good quality, but disadvantageous in that the time required for a colored image to be produced is long and the system is highly expensive. The thermal-transfer color copying system is problematic because color reproducibility is poor since three color images are superposed on a sheet. The electrophotographic color copying system can copy colored images at the fastest rate and with better resolution.

FIG. 10 of the accompanying drawings shows one general electrophotographic color copying system. A visible-light color separation filter a is angularly positioned such that its red filter element capable of passing red light only is located in a light path, and light emitted from a light source c is applied to a colored original b to scan the original b. Light reflected from the original b is guided by reflecting mirrors d and a lens e to pass through the color separation filter a for forming a red-light latent image on a photosensitive drum f. As the photosensitive drum f rotates about its own axis, the red-light latent image is developed into a visible image with cyan toner by an image developing unit g. After the developed image has been transferred to a recording sheet around a transfer drum h, a green filter element of the color separation filter a is set in the light path, and light is applied to the colored orignal b to form a latent image on the photosensitive drum f. The latent image is then developed into a visible image with magenta toner by the image developing unit g. The developed image is then transferred to the recording sheet. Finally, light reflected from the original b is passed through a blue filter element to form a latent image on the photosensitive drum f, which is developed with yellow toner, and the visible image is then transferred to the recording sheet. After the color-separated images have been transferred to the recording sheet, they are fixed to the recording sheet by an image fixing device j, whereupon the recording sheet with a colored image reproduced thereon is discharged onto a sheet tray k.

In the conventional electrophotographic color copying apparatus, light reflected from the original is separated into colored lights by the red, green and blue filter elements to form respective electrostatic latent images, to which corresponding dry toners are attached. The toners are thereafter transferred to the recording sheet. With the aforesaid system, since the light reflected from the original is separated into color lights, the light energy applied to the photosensitive drum is generally small. Inasmuch as the photosensitive material which the photosensitive drum is made of is less sensitive to light in longer wavelengths, it has been necessary to increase the light output from the light source or the sensitivity of the photosensitive material in the visible light wavelength range has to be adjusted for a higher level.

Various processes have heretofore been available for producing a video hard copies in full colors. These known processes are as follows:

(1) A CRT is used as a light source for emitting light bearing image information to be reproduced on a recording medium such as silver-salt photographic film which may be an instant color film. On example of this system is a silver-salt photographic CRT printer disclosed in Television Society Journal Vol. 40, No. 11 (1986).

(2) An image recording system disclosed in Japanese Patent Publication No. 61-281764 employs a photosensitive pressure-sensitive sheet coated with colorless leuco dyes which will develop colors of cyan (C), magenta (M), and yellow (Y) when brought into contact with a color developer and also with microcapsules made of ultraviolet-curing resin. After the photosensitive pressure-sensitive sheet has been exposed to light bearing image informaiton which is emitted from a CRT that emits ultraviolet radiations having wavelengths of c, m, n, those microcapsules which are not exposed to the radiations and hence not photoset are ruptured under a sufficient pressure to develop colors for thereby developing a color image.

(3) A PPC color electrophotographic copying system employs an electrophotographic photosensitive body made of selenium (Se) or an organic photosensitive material (OPC). After the photosensitive body has been exposed to light representing image information which is emitted from a CRT, and LED, or a laser beam source, the latent image on the photosensitive body is developed successively with toners of C, M, Y. The developed toner image is then transferred onto a sheet of plain paper.

According to the conventional copying systems (1) and (2), the recording medium has independent different spectral sensitivities with respect to image information in red (R), green (G), and blue (B). Therefore, although the wavelengths of lights emitted from the CRT may not necessarily be in full accord with the wavelengths of three primaries, i.e., R=550 nm, G=550 nm, B=450 nm, it has been necessary to provide a recording medium which is sensitive to mutually independent spectral wavelengths which correspond to image information in R, G, B.

With the color image copying system (1), in particular, if an instant color film used as a recording medium is to be interchangeable with a commercially available color photographic film, the CRT must have those types of phosphors which can produce spectral outputs respectively in the wavelengths of R=550 nm, G=550 nm, B=450 nm. However, it is generally difficult to obtain the phosphors of such spectral wavelengths, and hence the color reproducibility of this system has failed to reach an ideal level.

The film used is usually of a cabinet size or a smaller size. Therefore, for reproducing greater image sizes, special films and exposure and fixing devices have to be manufactured and their costs are expensive.

In the color image reproducing process (2), the pressure for rupturing the microcapsules which are not exposed to light to bring their contents into contact with the color developer for color development needs to be in the range of from 500 to 600 $Kg/cm^2$. Consequently, the pressure developing device required is large in size and highly costly. In order to set the spectral sensitivities of microcapsules to mutually different wavelength ranges corresponding to respective R, G, B image signals, it is necessary to mix sensitizers in the photo-setting resin or to uniformly disperse and coat the microcapsules corresponding to the respective wavelengths on a support. This results in an increased cost of manufacture of the recording medium.

According to the copying system (3), exposure, development, and transfer cycles for image information in R, G, B are independently repeated. Therefore, the exposure light source used may be of a single wavelength output capability, and the spectral sensitivity of the photosensitive body may be in a narrow wavelength range corresponding to that of the light source. However, images produced by this color copying apparatus are inevitably subjected to disturbance due to toner image transfer to the sheet of plain paper. In order to prevent the toner images in C, M, Y from being put out of registry with each other when transferring them onto the sheet, various measures have to be taken to keep a photosensitive drum and a transfer drum on which the sheet of plain paper is wound in exact synchronism with each other. For this reason, the entire apparatus is large in size and complex in structure. In addition, not all color images of any desired lengths can be recorded because of the limited circumferential length of the transfer drum.

SUMMARY OF THE INVENTION

In view of the aforesaid drawbacks of the conventional image recording apparatus, it is an object of the present invention to provide an image recording apparatus for recording an image on a phtoosensitive sheet while employing a relatively small light source and power supply.

Another object of the present invention is to provide a photosensitive sheet which is of a simple structure for use as an overhead projector sheet.

Still another object of the present invention is to provide an image recording apparatus having a wire-dot-matrix exposure device of a low cost capable of recording images at an increased speed.

Yet another object of the present invention is to provide a color image recording apparatus capable of recording a colored image with good reproducibility at high resolution.

A further object of the present invention is to provide a color image recording apparatus which includes an exposure light source of a reduced cost for emitting light of a single wavelength to expose a photosensitive image recording medium to image information in three primaries, i.e., R, G, B, and which employs a photosensitive image recording medium that has spectral sensitivities in narrow wavelengh ranges independent of the R, G, B image information and can be manufactured easily and inexpensively.

A still further object of the present invention is to provide a color image recording apparatus capable of recording an image in full colors on an elongate recording medium of any desired length by successively effecting exposure and development processes for image information in three primaries of R, G, B.

According to the present invention, there is provided an image recording apparatus comprising:

a first light source for applying light to an original;

a photosensitive member unit with light transmittance thereof being variable dependent on light reflected from the original and applied thereto;

a second light source for applying light to photosensitive sheet having a photoconductive layer on a electrically conductive support layer through the photosensitive member exposed by the reflected light from the original to form an electrostatic latent image on the photosensitive sheet; and means for developing the electrostatic latent image into a visible toner image.

According to the present invention, there is also provided an image recording apparatus comprises:

a scanning system for scanning an original for changing a photo image information of the original into an electric image information, the scanning system having a three-color separation filter for a color copying operation;

an intermediate image forming system comprising an intermediate film, a print head means for forming an intermediate image of the original on the intermediate film in response to the electric image information of the original, and a three-color ink ribbon;

an exposure system comprising an exposure light source disposed over a running path of the intermediate film having an intermediate image formed by the intermediate image forming system, a three-color separation filter disposed between the exposure light source and the intermediate film, and a transfer member for holding and transferring a photosensitive sheet which is exposed to light emitted from the exposure light source and passing through the intermediate film to form an electrostatic latent image; and an image developing means disposed close to the transfer member for developing the latent image on the photosensitive sheet into a visible image.

According to the present invention, there is also provided an image recording apparatus comprising:

a photosensitive sheet movably held by a holding means and comprising an electrically conductive base and a photosensitive layer disposed thereon and composed of titanium dioxide and a binder;

an exposure light source for emitting electron beam to the photosensitive sheet in response to TV signals, the exposure light source comprising a CRT having an output light intensity in a wavelength range from 40 to 420 nm; and a developing means for developing a latent image on the photosensitive sheet.

According to the present invention, there is also provided a photosensitive sheet for use on an overhead projector, comprising;

a transparent support layer;

a transparent electrically conductive layer disposed on the transparent support layer; and a photoconductive layer disposed on the transparent electrically conductive layer and made of a medium having a relatively high refractive index and a photoconductive material.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENTS

Figure 1:
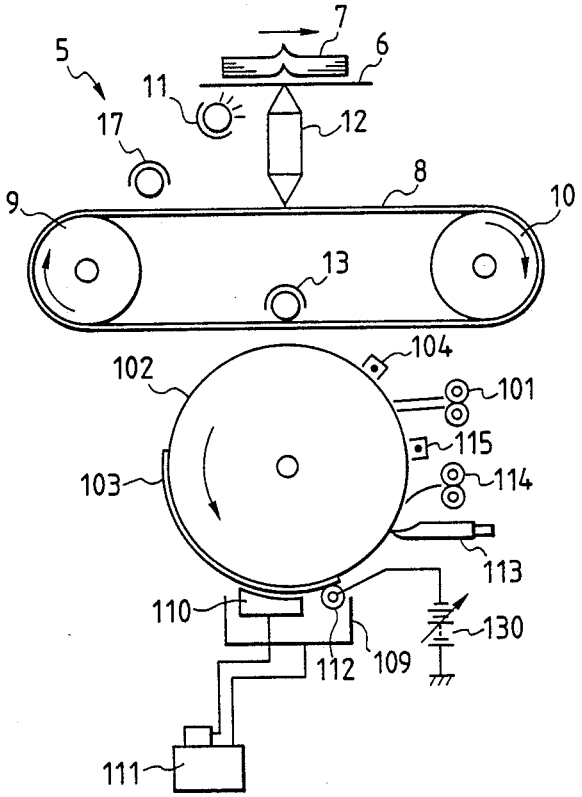
FIG. 1 is a schematic vertical cross-sectional view of an image recording appratus according to an embodiment of the present invention.

An image recording apparatus according to an embodiment of the present invention will be described with reference to FIG. 1.

The image recording apparatus, generally designated by the reference numeral 5, which will typically be used as a copying machine, for example, includes an original table 6 for supporting thereon an original 7 to be imaged or copied. Below the original table 6, there is disposed an endless photochromic photosensitive belt 8 that is supported by a pair of horizontally spaced drums or rollers 9, 10 for circulatory movement in a clockwise direction. The belt 8 comprises e.g. a PET sheet containing polycyclic compound, spirocompound, fulgide, etc. The polycyclic compound and spirocompound become transparent when they are exposed to visible light. A first light source 11 is positioned below the original table 6 for applying light to the original 7 placed on the original table 6. Light emitted from the light source 11 and reflected from the original 7 is focused by a condenser lens 12 in the form of a dot lens array onto the photosensitive belt 8. The original table 6 is movable to the right in FIG. 1 in synchronism with the movement of the photosensitive belt 8. The wavelength of light emitted from the first light source 11 is the same as the wavelength of the light which can be sensed by the photosensitive belt 8.

A second light source 13 is disposed in confronting relation to a transfer drum 102 with the lower run of the photosensitive belt 8 interposed therebetween. A photosensitive sheet 103 is supported on and movable synchronously with the transfer drum 102. The sheet 103 comprises a photosensitive sheet coated with fine partides of photoconductive $TiO_2$. The second light source 13 emits light in a wavelength range which is not the same as that of the light that can be sensed by the photosensitive belt 8, but which is the same as the wavelength of the light that can be sensed by the photosensitive sheet 103.

Around the transfer drum 102, there are located sheet feed rollers 101, a charger 104, an image developing unit 109, an image development confronting electrode 110, an image developing solution tank 111, an electrically conductive doctor roller 112 of metal to which a voltage can be applied by a power supply 130, an air jet nozzle 113, a pair of sheet discharge rollers 114, and a charge eraser 115.

The light emitted from the first light source 11 is reflected by the original 7 on the original support 6 and focused onto the photochromic photosensitive belt 8 by the condenser lens 12. A photochromic material is capable of reversibly switching between structures A and B when exposed to light, and such a structural shift results in a change in the absorption spectrum, i.e., a change in color. The shift from the structure B to the structure A is caused to progress by a device which shields light from application to the material, and is promoted when subjected to external energy such as heat or light of a different wavelength.

The photochromic photosensitive belt 8 is colored when it has the structure A, and becomes colorless or transparent when it has the structure B. When the image of the original 7 is focused on the photosensitive belt 8, a bright area on the original 7 becomes colorless or transparent on the photosensitive belt 8, and a dark area on the original 7 remains colored on the photosensitive belt 8. Therefore, the image of the original 7 is formed on the photosensitive belt 8. In contrast, in case that a PET sheet containing silver hologenide is used as a photochromic photosensitive belt, when the image of the original is exposed, a bright area on the original 7 becomes dark and a dark area remains as it is.

The photosensitive sheet 103 is supplied by the sheet feed rollers 101 onto the circumferential surface of the transfer drum 102 and then held on the transfer drum 102 by e.g. a clip mechanism. Upon rotation of the transfer drum 102, the photosensitive sheet 103 is first e.g. negatively uniformly charged by a corona discharge produced by the charger 104. Then, an electrostatic latent image which corresponds to the image on the photosensitive belt 8 is formed on the photosensitive layer of the photosensitive sheet 103 by the second light source 13. That is, the belt 8 becomes transparent at a bright area corresponding to a non-image area of the original 7 while remained as it is at a dark area corresponding to an image area of the original 7. Accordingly, the light emitted from the second light source 13 passes through the non-image area to discharge a part of the sheet 103, corresponding to the non-image area of the belt 8. An image area of the sheet 103 is ready for attracting fine particles of toner. Thereafter, the electrostatic latent image is developed into a visible image by the image developing unit (container) 109 with an image developing solution containing toner, in response to application of a prescribed potential to the image development confronting electrode 110. This electrode 110 has the same polarity as the toner thereby to function to push the toner toward the sheet 103 by a repulsive force between the toner and the electrode 110.

Then, the photosensitive sheet 103 with the visible image carried thereon is delivered to the electrically conductive roller 112 connected to a power source 130. The roller 112 applies, to the photosensitive sheet 103, a voltage which is higher than the remaining potential in a non-image area of the sheet 103 and is of the polarity opposite to that of the toner particles in a remaining image developing solution attached to the surface of the photosensitive layer of the sheet 103, for thereby removing the remaining toner particles from the sheet 103 while smoothing the toner layer on the sheet 103 and removing part of the remaining developing solution from the sheet 103. Substantially, the photosensitive sheet 103 is fed to the air jet nozzle 113, which ejects air against the sheet 103 to reduce the amount of the toner carrier solution on the sheet 103 down to a prescribed quantity without disturbing the toner layer in the image area on the sheet 103. Then, the photosensitive sheet 103 is discharged from the image recording apparatus 5 by the discharge rollers 114.

If the PET sheet containing silver hologenide is used as the belt 8, a non-image area of the original 7 becomes dark on the belt 8, while an image area is remained at it is. This exposure condition is opposite to that in the case of using polycyclic compound. In this case, a reverse development operation is carried out in the developing unit 109.

The photosensitive belt 8 may be moved again without energizing an erasing unit 17, comprising a light source which emits light in a range of wavelength capable of returning the exposed area of the belt 8 to an original condition, to bring its image carrying area into a position where the image carrying area is superposed on a new photosensitive sheet 103, and then the second light source 13 may be energized again to expose the new photosensitive sheet 103 to light emitted from the second light source 13 through the image carrying area of the photosensitive belt 8. In this manner, a plurality of copies can be reproduced on respective photosensitive sheets 103 by exposing the photosensitive belt 8 to the original 7 only once.

Since the photosensitive sheet 103 is exposed to light passing through the photosensitive belt 8 from the second light source 13 while being superposed on the photosensitive belt 8, the second light source 13 may be of a relatively small size in comparison with the first light source 11 for emitting light to the belt 8 through the original 7.

In the illustrated embodiment, the photochromic photosensitive belt 8 may be constructed of an organic thionine compound, or another photochromic material which is colorless or transparent when it is of the structure A and colored when it is of the structure B.

Figure 2:
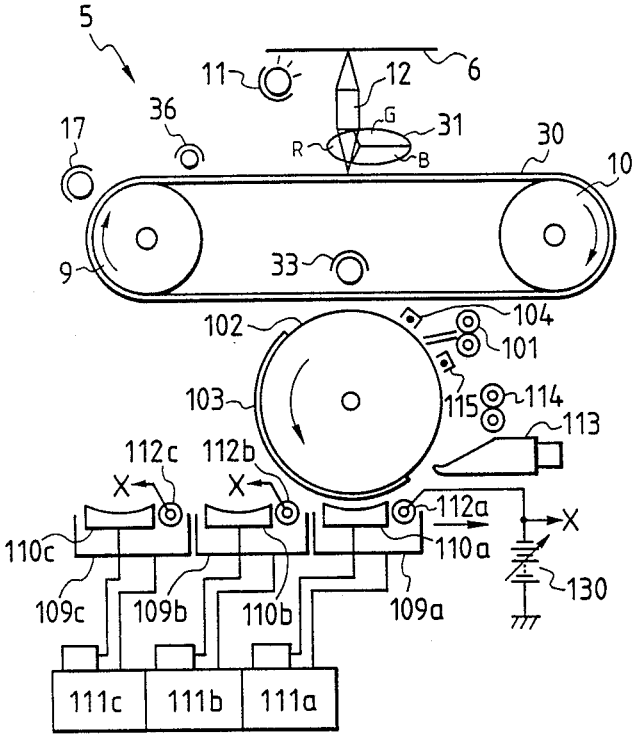
FIG. 2 is a schematic vertical cross-sectional view of an image recording apparatus according to another embodiment of the present invention.

FIG. 2 shows an image recording apparatus according to another embodiment of the present invention, the image recording apparatus being constructed as a color copying apparatus.

Those parts of the image recording apparatus shown in FIG. 2 which are identical to those of the image recording apparatus of FIG. 1 are denoted by identical reference numerals.

A color separation filter 31 is disposed between the condenser lens 12 and a photosensitive belt 30. Three image developing units 109*a*, 109*b*, 109*c* are movably disposed below the transfer drum 102 for developing images in cyan, magenta, and yellow, respectively. The image developing units 109*a*, 109*b*, 109*c* have respective image development confronting electrodes 110*a*, 110*b*, 110*c*, and electrically conductive doctor rollers 112*a*, 112*b*, 112*c*, and are connected to respective image developing solution tanks 111*a*, 111*b*, 111*c*. In FIG. 2, an auxiliary eraser 36 is provided in addition to the main eraser 17.

In operation, the photosensitive belt 30 having a photochromic layer is exposed to light from an original through a red filter element of the color separation filter 31 to form a latent image corresponding to red on the photosensitive belt 30. Then, a photosensitive sheet 103 on the transfer drum 102 is exposed to light emitted from a second light source 33 through the red latent image on the photosensitive belt 30. The image thus formed on the sheet 103 is then developed into a visible image with cyan toner. Thereafter, light is applied to the photosensitive belt 30 through a green filter element of the color separation filter 31, and then the image on the sheet 103 is developed with magenta toner. Similarly, light is applied to the belt 30 through a blue filter element, and then the image on the sheet 103 is developed with yellow toner. By successively effecting the above three developing cycles, a color image is reproduced on the photosensitive sheet 103. The photosensitive sheet 103 on which a color image is to be formed is not required to be a specially processed sheet which is coated with color dyes for sensitivity to red, green, and blue lights.

Figure 3:
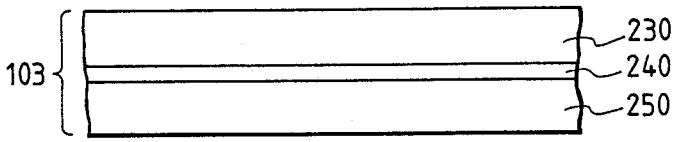
FIG. 3 is a fragmentary cross-sectional view of a photosensitive sheet according to the present invention.

FIG. 3 illustrates a photosensitive sheet according to the present invention. The photosensitive sheet, generally denoted at 103, comprises a transparent support layer 250, a transparent electrically conductive layer 240 deposited on support layer 250, and a layer 230 deposited on the transparent electrically conductive layer 240 and made of a photoconductive material mixed in a material of a high refractive index.

The transparent support layer 250 is in the form of a transparent layer. The transparent electrically conductive layer 240 is made of a transparent electrode material such as $SnO_2$, ITO or the like deposited on the support layer 250 as by vacuum evaporation. The photoconductive material of the layer 230 is preferably $TiO_2$ or the like. As is well known in the art, since the refractive index of $TiO_2$ is high, i.e., ranging from 2.5 to 2.8, the layer 230 has a highly opacifying effect. Where $TiO_2$ is mixed in an ordinary medium, the layer 230 looks white due to diffusion because the difference between the refractive indexes of the mixed materials is large. In this embodiment, the medium in which $TiO_2$ is mixed is preferably a material having a high refractive index, such as vinylcarbazole having a refractive index of 1.68, or tellurite glass composed mainly of $TeO_2$ and having a reflractive index of 2.1. The high-refractive index material may be mixed in the photoconductive material in advance, or may be coated on the sheet 103 after an image carried thereon has been developed.

The photosensitive sheet 103 shown in FIG. 3 is suitable for use on an overhead projector and may be used in the image recording apparatus illustrated in FIGS. 1 and 2.

The photosensitive sheet 103 of FIG. 3 is of a simple structure, can be manufactured in a relatively easy process, and is of high resolution.

A color image recording or copying apparatus according to yet another embodiment of the present invention will be described with reference to FIG. 4. This embodiment is, in principle, similar to the embodiments of FIGS. 1 and 2.

The color image recording apparatus includes an original cover 402 for holding an orignal 401 down on an original table (not shown). A light source 403 for emitting visible light is positioned in confronting relation to the image surface of the original 401. Light emitted from the light source 403 and applied to the original 401 is reflected and applied via an optical lens 404 to a mask member film 405 which is stored in a bin 406 until needed. The mask member film 405 is of such a photosensitive nature that an area thereof which has been exposed to light becomes permeable to light when it is subjected to image developing and fixing processes by an image developing and fixing device 411. The mask member film 405 and the image developing and fixing device 411 may comprise a commercially available film and slide producing machine which are manufactured and sold by Polaroid. Between the optical lens 404 and the original 401, there is disposed a visible-light color separation filter 407 comprising a red filter element 408 for passing red light only therethrough, a green filter element 409 for passing green light only therethrough, and a blue filter element 410 for passing blue light only therethrough. A photosensitive sheet 415 can be positioned below a mask member film 414 which has been processed by the image developing and fixing device 411. A white light source 416 is disposed above the photosensitive sheet 415. Light emitted from the white light source 416 is applied to the photosensitive sheet 415 through an optical lens 417 which is located between the white light source 416 and the mask member film 414. The photosensitive sheet 415 is supplied from a photosensitive sheet stacker 419 storing a stack of photosensitive sheets 415. Each of the photosensitive sheets 415 comprises a photosensitive recording sheet of paper which is coated with fine particles (having a diameter of 0.1 m or less) of photoconductive $TiO_2$ which is sensitized with dyes or coloring matter to match the wavelength of white light emitted from the light source 416. Denoted at 424 are transfer rolls, 425 a film stacker for storing a stack of mask member films that have been used, and 420 image developing and fixing devices for applying yellow, cyan, and magenta toners to the photosensitive sheets 415.

For copying or recording a colored image in the color image recording apparatus thus constructed, the red filter element 408, the green filter element 409, and the blue filter element 410 are successively brought into a light path along which light reflected from the original travels. The light reflected from the original 401 is passed successively through the filter elements 408, 409, 410 and applied to the mask member film 405 including film sections **405*a*, 405*b*, 405*c* for forming images thereon, which are then developed and fixed by the image developing and fixing device 411 to produce the mask member film 414 including film sections 414*a*, 414*b*, 414*c*. At this time, since only red light passes through the red filter element 408, only the red light reaches the mask member film section 405*a*. Since the area corresponding to the red light must be blank on the developed and fixed mask member film section 414*a*, the mask member film 405 should be positive film. Similarly, the area corresponding to the green light is blank on the mask member film section 414*b*, and the area corresponding to the blue light is blank on the mask member film section 414*c*. Light emitted from the light source 416 and passed through the film section 414*a* falls on the photosensitive sheet charged by a charger 430 in advance to form an electrostatic latent image thereon which corresponds to red, and wet-type toner corresponding to red is applied to the sheet 415 by the transfer rolls 424** for developing and fixing the red image. Likewise, light is applied through the film section 414*b* to form an electrostatic latent image corresponding to green, which is then developed into a green image with toner, and finally an electrostatic latent image corresponding to blue is developed with toner. In this fashion, a colored image can be recorded or copied while applying light from the white light source 416 most efficiently to the photosensitive sheet 415.

The mask member film 405 may be formed in other ways. For example, the light reflected from the original 401 may be separated into color images of red, green, and blue which may then be applied as digital input signals to a controller for controlling a thermal head and an electrically energizable head to produce a monochromatic film.

Figure 4:
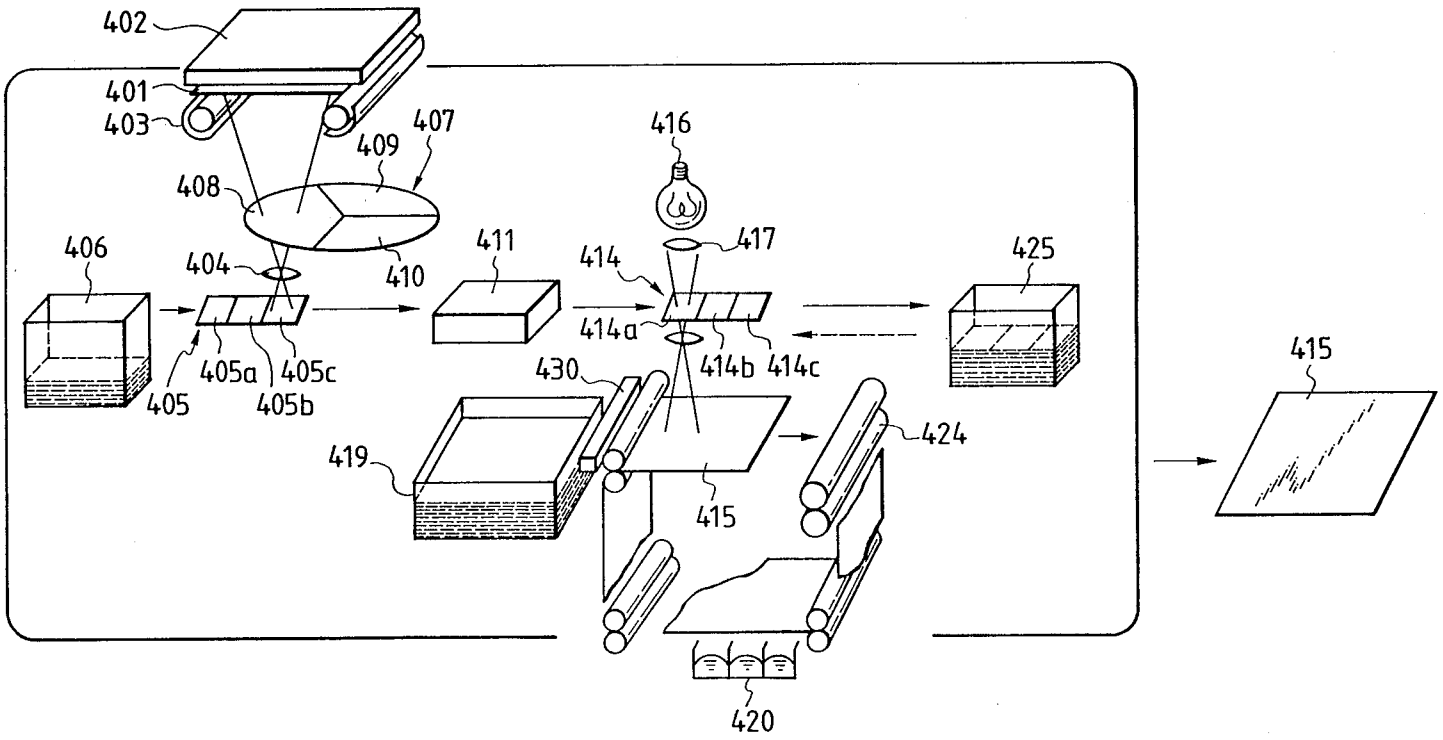
FIG. 4 is a schematic perspective view of a color image recording apparatus according to yet another embodiment of the present invention.

With the arrangement shown in FIG. 4, since the photosensitive sheet 415 is exposed to white light through the mask film or intermediate film bearing negative images, which is produced by separating light reflecting from the original 401 into three colors, the photosensitive sheet 415 can be exposed to a greater amount of light than photosensitive sheets employed in conventional electrophotographic color copying apparatus. Accordingly, a photosensitive material such as $TiO_2$ which is lower in sensitivity, but higher in gradation, than photosensitive materials such as aSi (amorphous silicon) and OPC can be used as a photosensitive sheet, with the consequence that colored images of high resolution and gradiation can be reproduced.

An image recording apparatus incorporating a wire-dot-matrix exposure device according to still another embodiment of the present invention will be described with reference to FIG. 5.

The image recording apparatus includes a scanning system comprising an original cover 302 for covering an original 301 to be imaged or copied, a light source or lamp 303 for applying light to the original 301, a focusing lens 304, a three-color separation filter 305, a CCD 306, and an amplifier 307. The image recording apparatus has an intermediate image forming system comprising a wire-dot-matrix printer head 308 operated by a driver circuit connected to the amplifier, a plain paper supply roll 310, a three-color ink ribbon 322 disposed between the plain paper as intermediate film 330 and the head 308 and a guide roll 340 for guiding the film 330. The image recording apparatus also includes an exposure system comprising a photosensitive sheet cassette 311 storing a stack of photosensitive sheets 312 each composed of an electrically conductive layer of aluminum which is coated with a layer of $TiO_2$, a transfer drum 313 for holding the photosensitive sheet 312, an exposure light source 314 disposed over the running path of a normal plain paper 330, a three-color separation filter 315 disposed between the running path of the paper 330 and the light source 314, a plain paper takeup roll 316, a charger 319 for charging the photosensitive sheet 312, a cleaner 320 disposed close to the surface of the drum 313, and a charge eraser 321 located near the cleaner 320. The image recording apparatus further includes wet-type image developing devices 317 and a pair of image fixing rollers 318.

Figure 5:
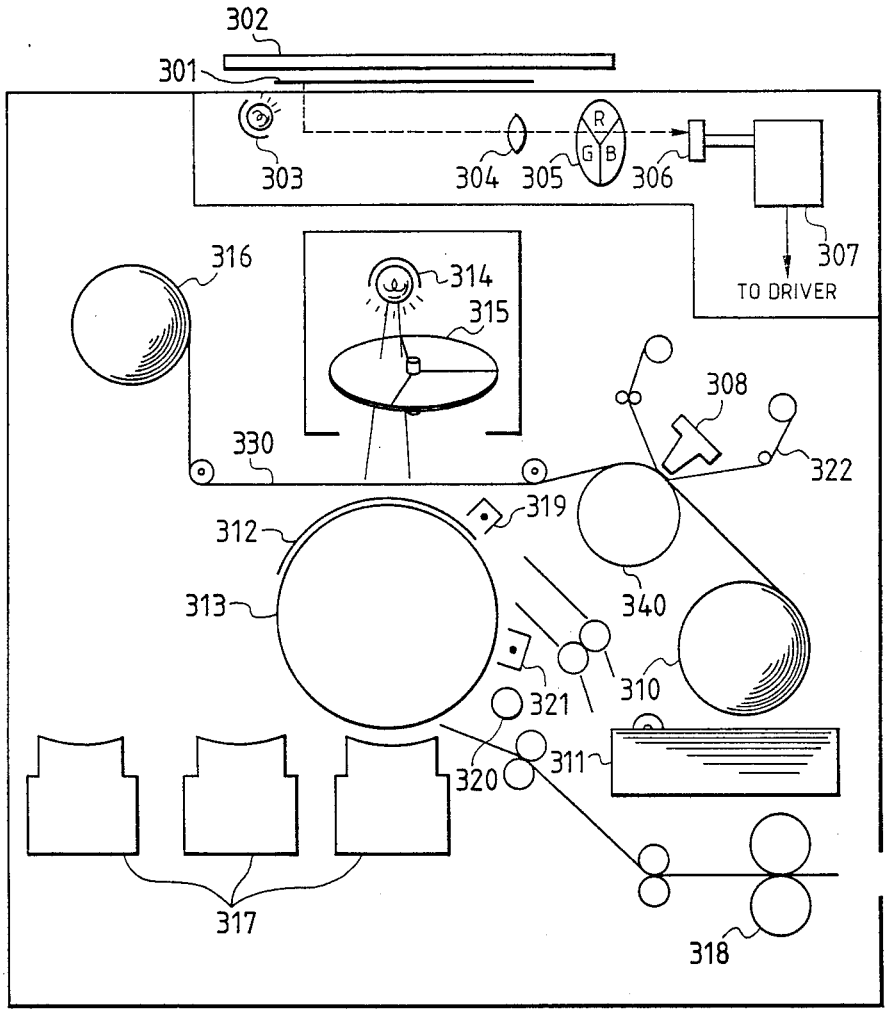
FIG. 5 is a schematic vertical cross-sectional view of an image recording apparatus including a wire-dot-matrix exposure device according to still another embodiment of the present invention.

Operation of the image recording apparatus shown in FIG. 5 is as follows: In the scanning system, light emitted from the exposure lamp 303 is applied to the original 301, and reflected by the original 301 and focused onto the CCD 306 by focusing lens 304. Changes in the intensity of the light falling on the CCD 306 are converted thereby to an electric signal that is used to control the wire-dot-matrix printer head 308 for forming an intermediate image on the intermediate film (i.e., the sheet unreeled from the supply roll 310) through a known three-color ink ribbon 322. The color ink ribbon 322 comprises a long sheet which has three color sections divided in the direction perpendicular (lateral direction) to the longitudinal direction of the ribbon 322 or divided in its longitudinal direction. The head 308 forms an intermedicate image while moving in response to a signal corresponding to each separated color image in synchronism with the paper 330. Three successive intermediate images corresponding to three separated color images are formed on the intermediate film in this matter.

When the transfer drum 313 rotates about its own axis, a photosensitive sheet 312 thereon is first uniformly cahrged by the charger 319 through a corona discharge. With a blue filter element of the three-color separation filter 315 being positioned below the exposure light source 314, the photosensitive sheet 312 is exposed to light emitted from the exposure light source 314 and passing through the light filter element and the normal paper 330 disposed along the sheet 312 to form an electrostatic latent image on the photosensitive layer on the photosensitive sheet 312. Then, the latent image is developed into a visible image with yellow toner corresponding to the light that has passed through the blue filter element. Thereafter, unwanted or excessive toner is removed from the transfer drum 313 by the cleaner 320, and any remaining charge is removed by the charge eraser 321. Two other color-separated images are subsequently successively formed and developed on the photosensitive sheet 312 in the same manner. Then, the photosensitive sheet 312 is passed between the image fixing rollers 318 to fix a colored image on the sheet 312. The intermediate film or plain paper sheet which has been consumed is wound on the takeup roll 316.

In the embodiment shown in FIG. 5, only one intermediate film is required to form a colored image on the photosensitive sheet 312. While the wire-dot-matrix printer head 308 is shown, the present invention is not limited to use of the wire-dot-matrix printer head 308. The principles of the present invention are also applicable to an exposure device employing a single intermediate film for reproducing a colored image, such as an exposure device wherein a thermal head is used to produce color-separated images on an intermediate film or an exposure system wherein color-separated intermediate images are produced by using three-color toners and a photosensitive body.

Because only one intermediate film is employed rather than three separate intermediate films, the present invention offers the following advantages:

The running cost of the image recording apparatus is low as the amount of intermediate film used is reduced.

Since only one intermediate film is employed, no strict registry between color-separated images is needed. Thus, various units such as sensors which would otherwise be necessary for image registration may be dispensed with, and the overall cost of the apparatus may be reduced. The degree of precision which would otherwise be required of components of a driving system for the apparatus may be lowered, and hence the process of manufacturing those components may be simplified and the manufacturing cost may be lowered.

Inasmuch as only a single intermediate film is used and no exact image registration is required, it is not necessary to wait for the photosensitive sheet to be exposed to light until an intermediate image is fully printed out, but the photosensitive sheet may start being exposed immediately from a line of an intermediate image which has just been recorded on the intermediate film. Accordingly, the running time of the image recording apparatus may be shortened.

For reproducing multiple copies of an image using three intermediate films, it has been necessary to wind back the intermediate films previously used or produce intermediate images again on intermediate films, so that the mechanism required has been complex and the running time has been long. According to the present invention, the single intermediate film remains on an exposure table, and only photosensitive sheets should be supplied successively. Therefore, the image recording apparatus of the invention has a much simpler mechanism than the conventional image recording apparatus, and the running time of the apparatus is shortened.

Figure 6:
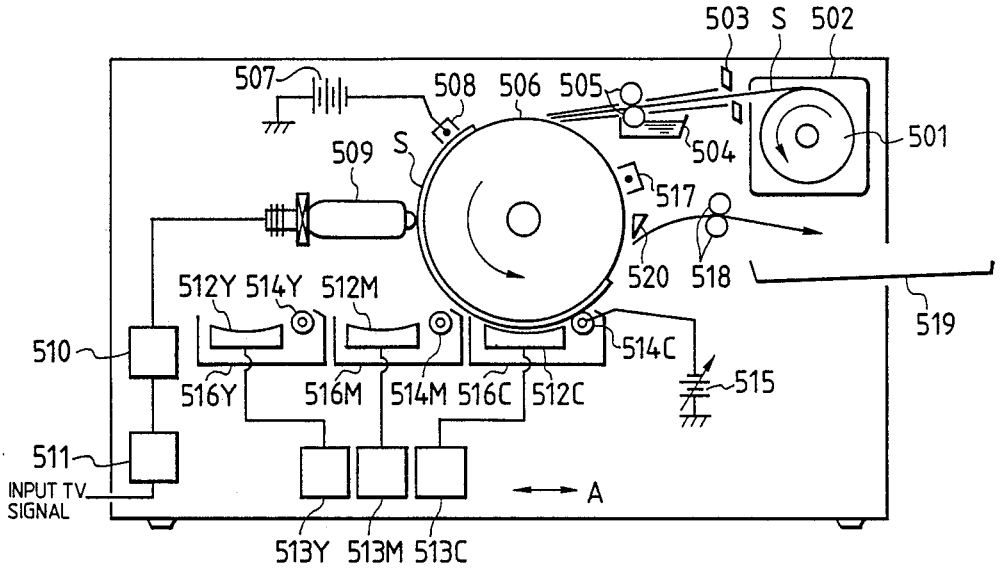
FIG. 6 is a schematic vertical cross-sectinal view of a color image recording apparatus according to a further embodiment of the present invention.

FIG. 6 shows a color image recording apparatus according to a further embodiment of the present invention, the color image recording apparatus employing a CRT for exposing a photosensitive sheet to image information.

As shown in FIG. 6, a photosensitive sheet S comprising an electrically conductive base coated with $TiO_2$ and a binder is wound to form a roll 501 housed in a light-shielding case 502. When an input television image signal is applied to the color image recording apparatus, the sheet S is unwound from the roll 501 and fed out of the case 502, and then cut off to a prescribed length. The cut sheet S is then wetted by a pair of wetting rollers 505 with a solution 504 which is the same as an image developing solution contained in image developing devices 516 (described later). The sheet S is then supported on and held in intimate contact with a drum 506, and is negatively charged by a corona charger 508 to which a high negative potential is applied by a power supply 507. Then, the input television signal is stored in a frame memory 511, after which an electron beam corresponding to R light is controlled by a CTR controller 511 to scan a line-type CRT 509 that is coated with a phosphor having a light intensity distribution in the vicinity of a main wavelength $\lambda=410$ nm, for thereby exposing the sheet S on the drum 6 to the electron beam. The drum 6 has its circumferential surface treated with a metal surface finish for easy intimate contact with the sheet S. The drum 6 is grounded for leaking charges from the sheet S to ground upon exposure. The line-type CRT 509 is moved for auxiliary scanning in synchronism with movement of the sheet S. More specifically, each time the sheet S is scanned one line in a main scanning direction, the drum 6 is angularly moved one pitch corresponding to one line in an auxiliary scanning direction. An electrostatic latent image corresponding to R light which has been formed on the sheet S by exposure to the electron beam is then developed by a cyan toner developing unit 516C by depositing cyan toner on an unexposed area (image area) on the sheet S. The cyan toner developing unit 516C, and other magenta and yellow toner developing units 516M, 516Y are movable in the directions of the arrow A by a suitable device, not shown. The developing units 516C, 516M, 516Y have image development electrodes 512C, 512M, 512Y, respectively, to which image developing bias voltages are applied by respective power supplies 513C, 513M, 513Y. The developing units 516C, 516M, 516Y also have respective electrically conductive rollers 514C, 514M, 514Y for applying, to a non-image area (exposed area) on the sheet S, a voltage which is higher than the remaining potential in the exposed area and of the polarity opposite to that of the toner potential, so that the non-image area will not be prevented from having a toner deposit. The voltage applied by the rollers 514C, 514M, 514Y is supplied by a power supply 515. Upon further rotation of the drum 506, the sheet S with its image developed by the cyan toner is then subjected to a corona discharge of a high AC or positive potential by a charge eraser corotron 517 to neutralize the surface potential of the sheet S.

The above cycle is thereafter repeated twice to develop a latent image corresponding to G light with magenta toner and also to develop a latent image corresponding to B light with yellow toner. As a result, a fully colored image is reproduced on the sheet S. Then, the sheet S is peeled off the drum 506 by a separator finger 520 and discharged into a tray 519 through a pair of developing solution recovery rollers 518 which squeezes excessive developing solution out of the sheet S. The entire process of color image recording is now completed.

Figure 7:
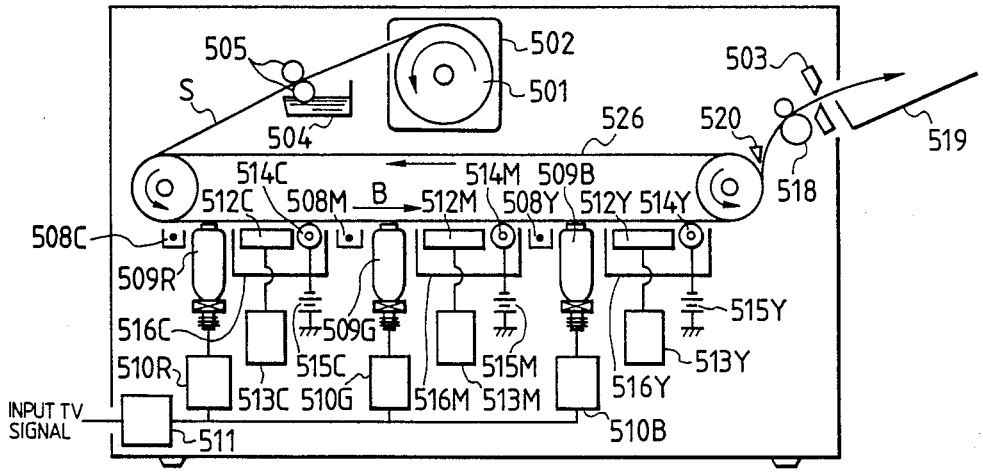
FIG. 7 is a schematic vertical cross-sectional view of a color image recording apparatus according to a still further embodiment of the present invention.

FIG. 7 shows a color image recording apparatus according to a still further embodiment of the present invention. The color image recording apparatus shown in FIG. 7 operates in basically the same process as the process of the color image recording apparatus shown in FIG. 1. In this embodiment, images of respective colors are developed successively on a continuous elongate sheet S, and an input television signal is applied to controllers 510R, 510G, 510B which controls respective linear CRTs 509R, 509G, 509B to expose the continuous sheet S to light in respective colors emitted from these CRTs. These CRTs 509R, 509G, 509B emit light having a wavelength in the vicinity of $\lambda=410$ nm for the respective color information of red (R), green (G), and blue (B). The continuous sheet S supplied from the case 502 is wetted by the wetting rollers 505, and then brought into intimate contact with an electrically conductive endless support belt 526 of stainless steel, Ni or the like. The continuous sheet S is then subjected to preliminary charge erasing, is successively charged by corona chargers 508C, 508G, 508Y, and then exposed to light from the CRTs 509R, 509G, 509B, successively. Thereafter, the latent images are developed, respectively, by the developing devices 516C, 516M, 516Y with respective cyan, magenta, and yellow toners. Respective power supplies 515C, 515M, 515Y are connected to the doctor rollers 514C, 514M, 514Y. By going through the above process, a fully colored image is reproduced on the sheet S for a desired length. Thereafter, the sheet S is delivered through the developing solution recovery rollers 518, cut to a desired length by the cutter 503, and the cut sheet is then discharged into the tray 519.

Figure 8:
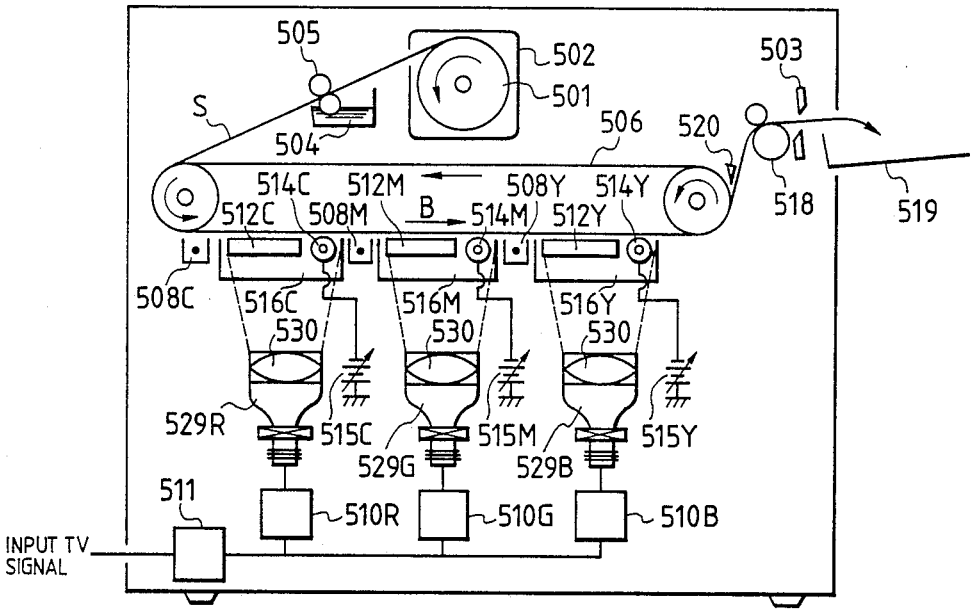
FIG. 8 is a schematic vertical cross-sectional view of a color image recording apparatus according to a yet still further embodiment of the present invention.
Figure 9:
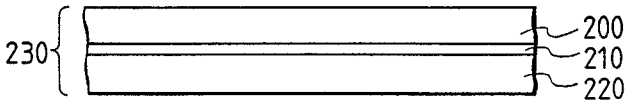
FIG. 9 PRIOR ART
FIG. 9 is a fragmentary cross-sectional view of a conventional photosensitive sheet.
Figure 10:
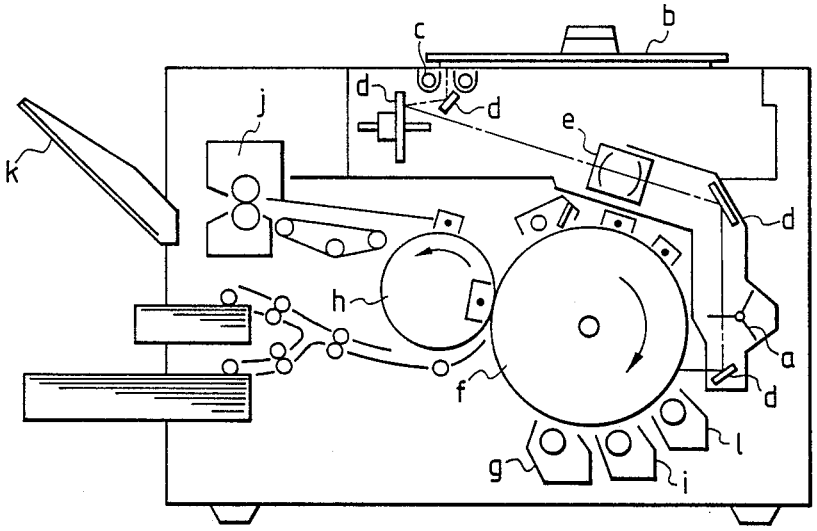
FIG. 10 PRIOR ART
FIG. 10 is a schematic vertical cross-sectional view of a conventional color image recording apparatus of the electrophotographic type.

FIG. 8 shows a color image recording apparatus according to a yet still further embodiment of the present invention, which is a modification of the color image recording apparatus illustrated in FIG. 7. The color image recording apparatus of FIG. 8 employs, rather than the line-type CRTs 509R, 509G, 509B, planar CRTs 529R, 529G, 529B combined with respective focusing lenses 530.

In this embodiment, it is not necssary to feed the continuous sheet S in the auxiliary scanning direction indicated by the arrow B during an exposure process. Since the planar CRTs 529R, 529G, 529B are spaced from the sheet S by the distance which is equal to the focal length of the focusing lenses 530, the CRTs 529R, 529G, 529B are prevented from being smeared by the developing solution in the developing devices 516C, 516M, 516Y. While the continuous sheet S is being exposed to light from the CRTs 529R, 529G, 529B, the developing devices 516C, 516M, 516Y are retracted out of the light paths of these CRTs to allow exposure. The other structural details and operation of the color image recording apparatus shown in FIG. 8 are the same as those of the color image recording apparatus shown in FIG. 7.

With the embodiment shown in FIGS. 6, 7 and 8, the photosensitive material of the titanium dioxide $TiO_2$ is highly white when it is in the form of fine powder, so that it can eliminate the effect of the color of a photosensitive support including an electrically conductive layer, and is hence ideal for use as a medium for carrying colored images. It is known that $TiO_2$ has a peak spectral sensitivity in the range of from 400 nm to 420 nm. The phosphor of the CRT which has its output light intensity in the wavelength range $\lambda=400$ nm to 420 nm to which $TiO_2$ is mainly sensitive is available relatively easily. One example of such phosphor is NP-101 (peak wavelength $\lambda p=421$ nm, half-width $\lambda\frac{1}{2}=29$ nm) manufactured by Nichia Chemicals.

According to the above arrangement, there is employed a so-called electrofax system wherein the photosensitive material is used as an image carrying medium. After an electrostatic latent image has been formed on the image carrying medium, the image is developed directly on the image carrying medium into a visible image. More specifically, the photosensitive sheet is unwound from its supply roll and is subjected to a preliminary charging erasing process (AC or positive charging) due to a corona discharge, and then negatively charged so as to be given a negative uniform surface potential. Then, in response to an input television image signal, the photosensitive sheet is scanned when an electron beam for the color R hits the phosphor of the CRT and enables the same to emit light. An area of the photosensitive sheet which corresponds to the area of the phosphor which does not emit light remains electrically insulative, and the negative surface potential remains in that area of the photosensitive sheet. An area of the photosensitive sheet which is scanned by the light emitted from the CRT phosphor is rendered electrically conductive, and the surface charge is drained to ground via the electrically conductive layer, whereupon an electrostatic latent image corresponding to R light is formed. Then, cyan (C) toner is deposited on the unexposed portion of the electrostatic latent image for normal image development. To this end, a bias potential which is slightly higher than the potential of the exposed portion and is of the same polarity as that of the unexposed portion is applied to a development electrode to prevent the toner from being attached to the exposed portion. The above process is repeated for exposing the photosensitive sheet to G light and developing the latent image with magenta (M) toner and also for exposing the photosensitive sheet to B light and developing the latent image with yellow (y) toner. By thus successively developing the images with C, M, Y toners, a fully colored image based on input image information or television signal applied to the CRT. Since a photosensitive body is required to be recharged through the toner layer in a next process, the toner should be low in resistance to the extent which will not obstruct the developing process. Specifically, the volumetric resistance of the toner should preferably be in the range of from $1\times10^4$ to $1\times10^{12}\Omega$-cm.

Therefore, the development process to be employed should preferably be a liquid development process employing an electrically insulative liquid in which fine colorant particles with an electrically insulating material added are dispersed, rather than a dry-type development process which employs powder toner.

Further, as described above, fine powder of $TiO_2$ which has its main sensitivity in the vecinity of a wavelength $\lambda=410$ nm is used as a photosensitive material without use of any dye sensitizer. The photosensitive material is exposed to light bearing image information from a CRT coated with a phosphor having a light intensity peak in the vicinity of a wavelength $\lambda=410$ nm for electrophotographically forming a latent image on the photosensitive material. Thereafter, the latent image is developed into a visible image by a wet-type developing cycle with fine colorant particles that are relatively highly electrically conductive and an insulative solution. This image developing cycle is repeated for developing the image with toners of cyan (C), magenta (M), and yellow (Y). Since the photosensitive material is not required to have independent different spectral sensitivities corresponding to image information in R, G, B, it is possible to provide an inexpensive photosensitive sheet which is highly white due to the powder nature of $TiO_2$.

The CRT or CRTs used emit light in the same wavelength for the colors R, G, B. Therefore, the CRTs may be of a common design and can be manufactured at a reduced cost. By arranging the color image recording apparatus for successively effecting charging, exposure, and development processes for C, M, Y, images can be recorded over a desired length in the auxiliary direction, i.e., elongate copies or prints can be produced.

In FIGS. 7 and 8, if necessary, an eraser may be provided between each developing unit and a next corona charger.

Although certain preferred embodiments have been shown and desired, it should be understood that many changes and modifications may be made therein without departing from the scope of the appended claims.

What is claimed is:

1. An image recording apparatus comprising:

a first light source for applying light to an original;

a photosensitive member with light transmittance thereof being variable dependent on light reflected from the original and applied thereto wherein the reflected light from the original is applied to the photosensitive member through a condenser lens, the photosensitive member is in the form of a running belt, and the original is moveable in synchronism with the movement of the photosensitive member;

a second light source for applying light to a photosensitive sheet having a photoconductive layer on an electrically conductive support layer through the photosensitive member exposed by the reflected light from the original to form an electrostatic latent image on the photosensitive sheet, wherein the second light source emits light in a wavelength range to which the photosensitive member is insensitive;

an eraser means is disposed near the running belt so as to erase an image formed on the photosensitive member;

a charger for applying charges uniformly on the photosensitive sheets;

means for developing the electrostatic latent image into a visible toner image; and a transfer means for transferring the photosensitive sheet charged by the charger to an exposure position on the transfer means nearest to the second light source at which the photosensitive sheet is exposed through the photosensitive member by the second light source.

2. An image recording apparatus as claimed in claim 1, wherein said transfer means comprises a drum for carrying the photosensitive sheet thereon.

3. An image recording apparatus according to claim 1, wherein the photosensitive sheet is supported on the surface of a transfer drum and the developing means comprises an image development electrode confronting the transfer drum, image developing container with an image developing solution containing toner and an electrically conductive roller for removing the unnecessary toner particles from the sheet.

4. An image recording apparatus according to claim 1, further comprising a color separation filter disposed between the original and the photosensitive member, through which the reflected light from the original is applied to the photosensitive member, and wherein the developing means has three developing units for developing images in cyan, magenta and yellow.

5. An image recording apparatus according to claim 1, further comprising a three-color separation filter disposed between the original and the photosensitive member and an image developing and fixing device for developing and fixing an image formed on the photosensitive member through the three-color separation filter, and wherein the photosensitive member is in the form of a plain mask member film which is of such a photosensitive nature that an area thereof which has been exposed to light becomes permeable to light when it is subjected to image developing and fixing processes and the photosensitive sheet is exposed to light emitted from the second light source and passing through the mask member film which has been processed by the image developing and fixing device.

6. An image forming apparatus for forming a color image, comprising:

a first light source for applying light to an original;

a color separation filter unit for separating the light from the original into plural color components;

a mask image forming unit having a photosensitive member with light transmittance thereof being variable dependent on light reflected from the original and applied thereto for forming plural mask images corresponding to the color components thereon, wherein each of the color components is applied to the photosensitive member through a condenser lens, the photosensitive member is in the form of a running belt, and the original is moveable in synchronism with the movement of the photosensitive member, and an eraser means is disposed near the running belt so as to erase the mask images formed on the photosensitive member; and an electrophotographic image forming unit comprising a second light source for successively applying light through each of the mask members to a photosensitive sheet having a photoconductive layer on an electrically conductive support layer to thereby form electrostatic latent images corresponding to the mask images on the photosensitive sheet, a transfer means for carrying thereon and transferring the photosensitive sheet to an exposure position on the transfer means nearest to the second light source at which the photosensitive sheet is exposed to the light, the light being in a wavelength range to which the photosensitive member is insensitive, a charger provided near to the exposure position for uniformly charging the surface of the photosensitive sheet, and plural color developing units for successively developing the electrostatic latent images into corresponding visible color images with color toners.

* * * * *